United States Patent [19]

Takenouchi et al.

[11] Patent Number: 4,946,398

[45] Date of Patent: Aug. 7, 1990

[54] CONNECTOR TERMINAL RETAINER

[75] Inventors: Kenji Takenouchi; Toshihiko Makita; Mitsuru Matsumoto, all of Shizuoka, Japan

[73] Assignee: Yazaki Corporation, Tokyo, Japan

[21] Appl. No.: 344,728

[22] Filed: Apr. 28, 1989

[30] Foreign Application Priority Data

May 6, 1988 [JP] Japan ..... 63-59415[U]

[51] Int. Cl.[5] ..... H01R 13/40

[52] U.S. Cl. ..... 439/599; 439/595; 439/752

[58] Field of Search ..... 439/594–599, 439/752

[56] References Cited

U.S. PATENT DOCUMENTS

| | | | |
|---|---|---|---|
| 4,660,915 | 4/1987 | Mantlik | 339/61 R |
| 4,713,021 | 12/1987 | Kobler | 439/599 |
| 4,721,482 | 1/1988 | Fukuda et al. | 439/595 |
| 4,758,182 | 7/1988 | Anbo et al. | 439/598 |
| 4,776,813 | 10/1988 | Wilson et al. | 439/595 |

*Primary Examiner*—P. Austin Bradley

*Attorney, Agent, or Firm*—Armstrong, Nikaido, Marmelstein, Kubovcik & Murray

[57] ABSTRACT

Described herein is a connector terminal retainer which is connectible to a rear portion of a connector housing to anchor terminal members in the respective terminal compartments in the connector housing. The terminal retainer is provided with; a pair of locking arms extending forward from opposite side walls of the terminal retainer body for engagement in socket portions in the connector housing, and constituted by a pair of vertical resilient portions extending parallely on opposite sides of a gap space formed in the longitudinal direction of the arm and a horizontal resilient portion extending over and along the gap space on the outer side of the vertical resilient portions; and provisional and main locking projection provided in longitudinally shifted positions on the vertical and horizontal resilient portions of the locking arms of interlocking engagement with corresponding jocking portions in the socket portions of the connector housing.

3 Claims, 3 Drawing Sheets

CONNECTOR TERMINAL RETAINER

BACKGROUND OF THE INVENTION

1. Field of the Invention

The present invention relates to a wire harness connector, and more particularly to a terminal retainer construction which is fittingly interlockable with a rear portion of a connector housing to prevent rearward dislodgment of terminal members which are inserted into terminal compartments in a wire harness connector housing.

2. Prior Art

For fixing in position the terminal members which are inserted into terminal compartments in a connector housing, it has been the general practice to provide flexible or resilient retainer arms integrally on the inner wall surfaces of each terminal compartment, which resilient retainer arms engage the terminal members upon insertion of the terminal members into the terminal compartment to prevent dislocation or dislodgment of the terminal members. Recently, a proposal has been made to provide a terminal retainer which is fittingly interlockable with a rear portion of the connector housing to prevent dislocation or dislodgment of the terminal members securely in cooperation with or in place of the above-mentioned resilient retainer arms.

FIG. 7 illustrates such a prior art terminal retaining structure, which is provided with support projections d on the inner surfaces of opposing wall portions c of each terminal compartment b in a connector housing a. Tapered drive surfaces e are formed on the rear side of each one of the support projections d, while temporary or provisional locking projections f and main locking projections g are provided in relatively rearward and forward positions on the outer wall surfaces with respect to the position of the housing a.

Indicated at h is a frame-like terminal retainer with resilient locking arms j and resilient retainer arms k extending forwardly from its frame-like body i respectively onto and into a connector housing a to be connected therewith.

The terminal retainer h is firstly joined with the housing a in a provisionally interlocked state where the resilient locking arms j are in interlocking engagement with the provisional locking projections f. In this state, the resilient retainer arms k are extended linearly forward without interfering with a terminal member l inserted into the terminal compartment b.

Nextly, as shown in FIG. 8, the terminal retainer h is pushed in further to bring the retainer into a finally interlocked state where the resilient locking arms j are in interlocking engagement with the main locking projections g. In this state, the fore ends $k_1$ of the resilient retainer arms k which are abutted against the tapered drive surface e are thereby bent inward to grip a terminal press-on wire portion m, and located behind support projections n and o of the terminal member l to prevent its dislodgment in the rearward direction.

In the above-described prior art terminal retainer, the resilient locking arms j which are located on the outer surfaces of the peripheral wall portions of the connector housing a are arranged to flex outward and exposed on the outer side in the locked position, so that they have possibilities of being deformed or unlocked by an external force. Besides, the provisional and main locking projections f and g which are provided on the peripheral wall of the connector housing to engage the resilient locking arms j successively. Therefore, it is necessary to provide an interval of a substantial length between the provisional and main locking projections f and g for engagement with the resilient locking arms j. This makes it difficult to provide a connector housing or a terminal retainer of a compact form.

SUMMARY OF THE INVENTION

In view of the foregoing situations, the present invention has as its object the provision of a connector terminal retainer construction which permits to provide provisional and main locking projections close to each other in the longitudinal direction of resilient locking arms and which is adapted to protect the locking arms against external forces.

In accordance, with the present invention, in order to achieve the above-mentioned objects, there is provided a connector terminal retainer of the type including a connector housing having a plural number of terminal compartments, terminal members to be inserted into the terminal compartments of the connector housing, and a terminal retainer fittingly interlockable with a rear portion of the connector housing stepwise through two stages; a stage of provisional interlocking and a stage of final interlocking, characterized in that the connector terminal retainer is provided with; a pair of locking arms extending forward from opposite side walls thereof for engagement with socket portions in the connector housing, and constituted by a pair of vertical resilient portions extending parallelly on opposite sides of a gap space formed in the longitudinal direction of the arm and a horizontal resilient portion extending over and along the gap space on the outer side of the vertical resilient portion; and provisional and main locking projections provided on the vertical and horizontal resilient portions in longitudinally shifted positions for engagement with corresponding locking portions in the socket portions provided in the connector housing.

The above and other objects, features and advantages of the invention will become apparent from the following description and the appended claims, taken in conjunction with the accompanying drawings which show a preferred embodiment of the invention by way of example.

DETAILED DESCRIPTION OF PREFERRED EMBODIMENTS

Figure 1:
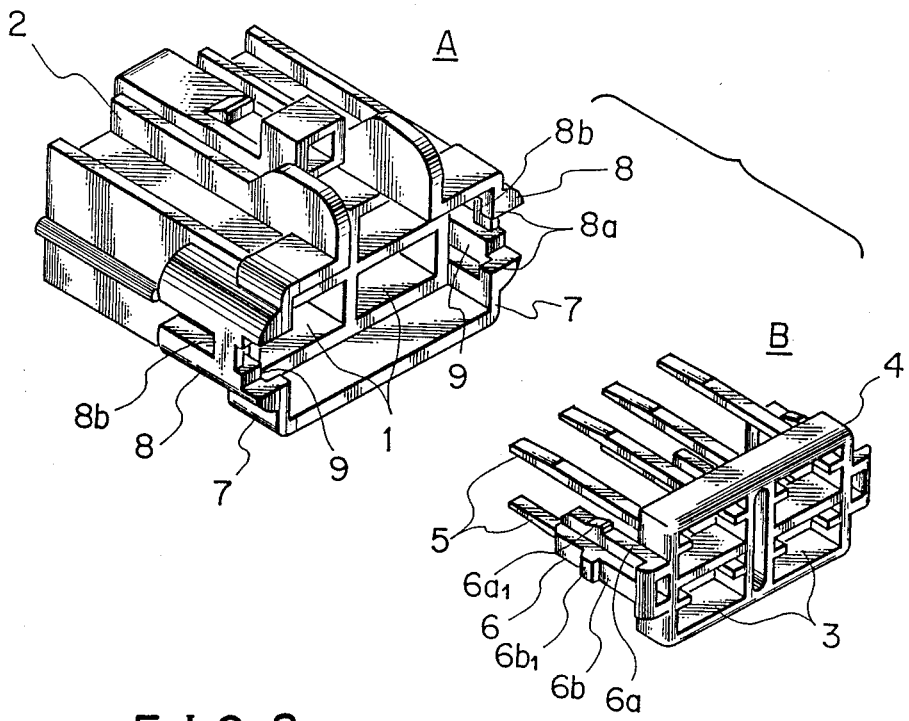
FIG. 1 is a perspective view of an embodiment of the invention in a disassembled state.
Figure 2:
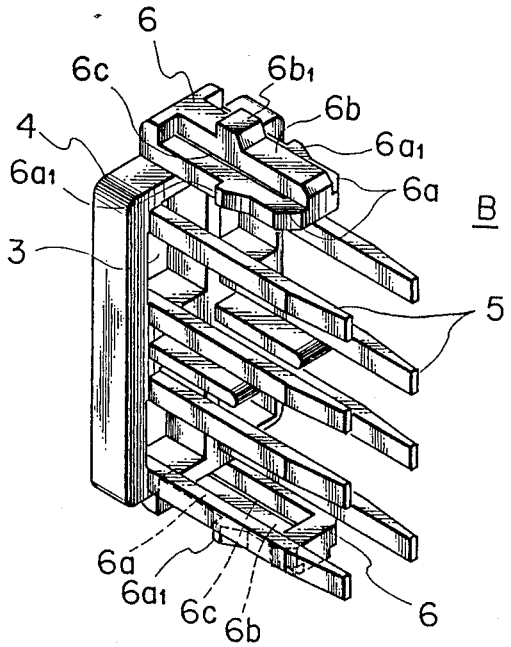
FIG. 2 is a perspective view of a terminal retainer with a resilient interlocking portion cut way for the convenience of illustration.

Illustrated in FIG. 1 is an embodiment of the invention, in which indicated at A is a male connector housing of a synthetic resin material, and at B is a terminal retainer similarly of a synthetic resin material to be filled on the rear end of the male housing A. The male connector housing A is constructed to mate a female connector housing which is not shown.

The connector housing A is provided with a plural number of upper and lower terminal compartments 1 side by side in parallel relation with each other. In the manner known in the art, each terminal compartment 1 has a front stopper at its front end along with a resilient terminal holder arm (not shown) which is formed integrally on an inner wall surface in an intermediate portion of the compartment. The reference numeral 2 denotes a resilient locking arm which is interlockable with the mating female connector housing.

The terminal retainer B has a frame-like main body 4 which is internally provided with openings 3 for inserting the wire ends (not shown) with the terminal members to be installed in the terminal compartments of the connector housing A, and a plural number of upper and lower resilient terminal-anchoring fingers 5 extending forward from the frame-like main body 4 correspondingly to the upper and lower terminal compartments 1. Further, a pair of locking arms 6 are extended from the opposite lateral sides of the main body 4 for engagement with the connector housing A.

Each one of the locking arms 6 is provided with a pair of vertical resilient portions 6*a* which are provided parallelly on the upper and lower sides of the arm 6 and spaced by a gap 6*c*, and a horizontal resilient portion 6*b* which is bridged along the gap 6*c* on one side of the vertical resilient portions 6*a* and movable into and out of the gap 6*c*. In this case, a provisional locking projections $6a_1$ is provided on each one of the vertical resilient portions 6*a*, while a main locking projection $6b_1$ is provided on the horizontal resilient portion 6*b* in a position rearward of the provisional locking projection $6a_1$.

The connector housing A is provided with bulged wall portions 8 is rear portions of its side walls 7, which bulged wall portions 8 are each formed with a socket portion 9 for receiving an opposing one of the locking arms 6. The bulged wall portions 8 are provided with inwardly projecting locking portions 8*a* which are formed at the rear ends of its upper and lower portions or at the entrance of the socket portion 9 for interlocking engagement with the provisional locking projections $6a_1$, and a locking portion 8*b* which is formed on its lateral side forward of the first locking portions 8*a* for interlocking engagement with the main locking projection $6b_1$ of the locking arm 6.

Figure 3:
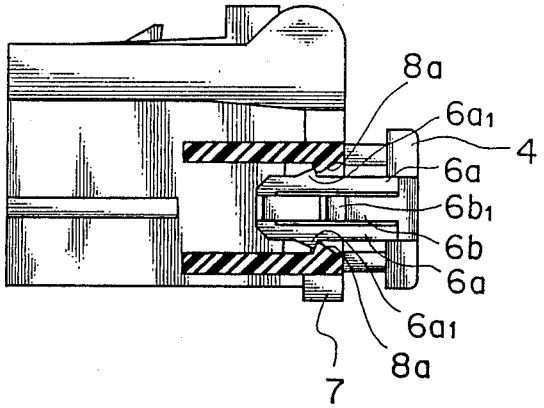
FIG. 3 is a partly cutaway side view of the connector housing and terminal retainer in provisionally interlocked state.

Prior to insertion of terminal members, the above-described connector housing A and terminal retainer B are joined in a provisionally interlocked state as shown particularly in FIG. 3, with the provisional locking projections $6a_1$ on the vertical resilient portion 6*a* in engagement with the locking portion 8*a* in the socket 9. In this state, terminal members connected with the wire ends are inserted into the terminal compartments through the openings in the terminal retainer B and engaged with the resilient terminal holders in the respective compartments.

Figure 4:
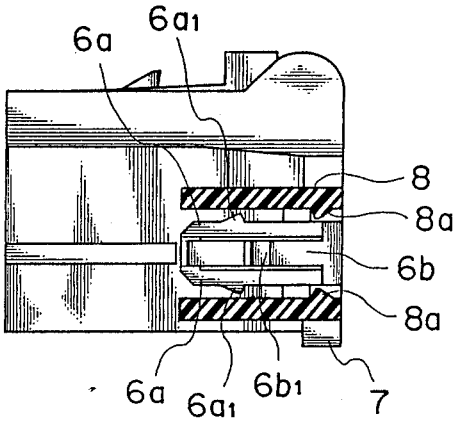
FIG. 4 is a partly cutaway side view of the connector housing and terminal retainer in finally interlocked state.

Nextly, as shown in FIG. 4, the terminal retainer B is further pushed into the connector housing A to assume the finally interlocked state where the main locking projections $6b_1$ on the locking arms 6 are engaged with the locking portions 8*b* in the sockets 9. By so doing, the terminal members are brought into engagement with the resilient locking fingers 5 thereby doubly preventing rearward dislodgement of the terminal members.

Figure 5:
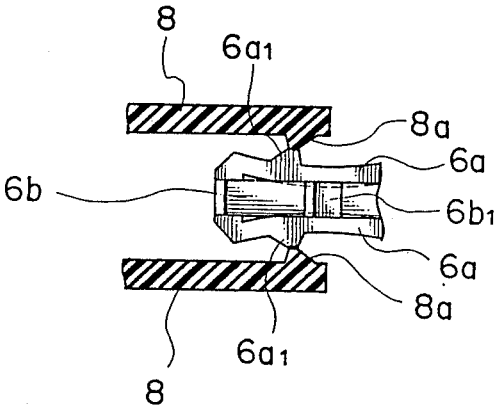
FIG. 5 is a schematic illustration explanatory of the operation of vertically resilient portions.
Figure 6:
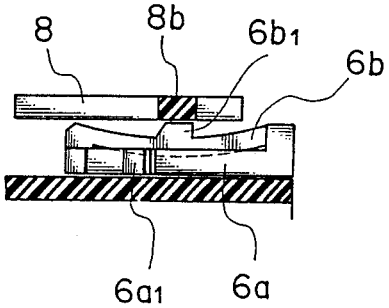
FIG. 6 is a schematic illustration explanatory of the operation of a horizontally resilient portion.
Figure 7:
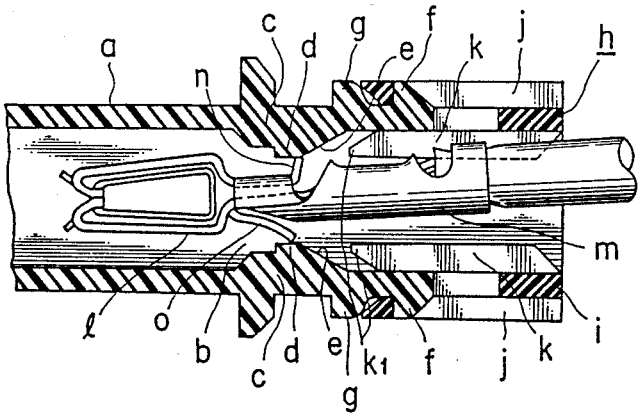
FIG. 7 PRIOR ART
FIG. 7 is a sectional view of conventional connector housing and terminal retainer in provisionally interlocked state.
Figure 8:
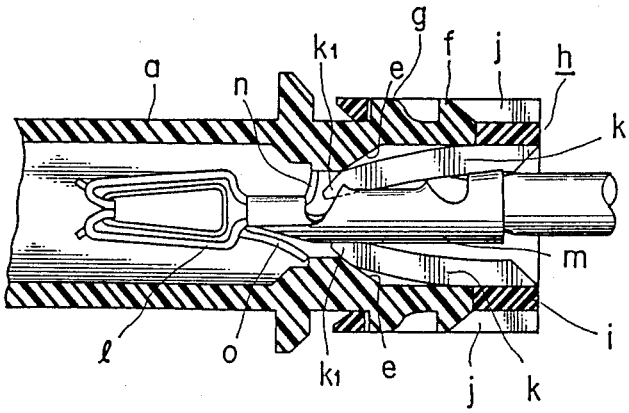
FIG. 8 PRIOR ART
FIG. 8 is a sectional view of the connector housing and terminal retainer of FIG. 7 in finally interlocked state.

When assuming the bove-described provisionally and finally interlocked states, the vertical resilient portions 6*a* make a flexural displacement through the gap 6*c* (FIG. 5), while the horizontal resilient portion 6*b* undergoes a flexural displacement into the gap 6*c* (FIG. 6).

As described hereinabove, in accordance with the present invention, the locking arms which join the terminal retainer with the connector housing are each constituted by vertical resilient portions and a horizontal resilient portion, and the locking projections are allotted to the respective resilient portions for engagement with locking portions which are provided on the upper, lower and lateral sides of socket portions on the connector housing. Therefore, it is possible to reduce the distance between the provisional and main locking projections to suit connector housings of compact designs, in addition to an advantage that the locking arms can be protected against external forces.

What is claimed is:

1. A connector terminal retainer comprising a connector housing having a plural number of terminal compartments, terminal members to be inserted in said terminal compartments, and a retainer having a frame-like body fittingly connectable to a rear portion of said connector housing stepwise through a stage of provisional engagement and a stage of final engagement, wherein said connector terminal retainer comprises;

a pair of locking arms extending forward from opposite side walls of said terminal retainer for engagement in socket portions in said connector housing, each locking arm comprising a pair of vertically resilient portions extending parallel on opposite sides of a gap space formed in the longitudinal direction of said arm and a horizontally resilient portion extending over and along said gap space on the outer side of said vertically resilient portions; and provisional and main locking projections provided in longitudinally shifted positions on said vertically and horizontally resilient portions of said locking arms for stepwise engagement with corresponding locking portions provided in said socket portions of said connector housings; wherein said socket portions comprise laterally bulged wall portions extended outwardly from the opposite sides of said connector housing and provided with first locking portions projecting inwardly at the rear end of each one of said bulged wall portion for interlocking engagement with said provisional locking projections on said locking arm and a second locking portion provided at the outer side of said bulged wall portion for interlocking engagement with said main locking projection on said locking arm.

2. A connector terminal retainer as defined in claim 1, wherein said provisional locking projection is provided on each one of said vertical resilient portions, and said main locking projection is provided on said horizontally resilient portion of said locking arm.

3. A connector terminal retainer as defined in claim 1, wherein said terminal retainer is provided with terminal anchoring fingers extending forward from said frame-like body for securely anchoring said terminal members in the respective terminal compartments in the finally interlocked state.

* * * * *